US011242795B2

(12) United States Patent
Wicks

(10) Patent No.: US 11,242,795 B2
(45) Date of Patent: Feb. 8, 2022

(54) PISTON COOLING SYSTEM

(71) Applicant: FORD GLOBAL TECHNOLOGIES, LLC, Dearborn, MI (US)

(72) Inventor: Christopher Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/092,784

(22) Filed: Nov. 9, 2020

(65) Prior Publication Data

US 2021/0054775 A1 Feb. 25, 2021

Related U.S. Application Data

(62) Division of application No. 15/957,127, filed on Apr. 19, 2018, now Pat. No. 10,858,982.

(51) Int. Cl.

| | |
|---|---|
| ***F01P 3/02*** | (2006.01) |
| ***F01P 3/08*** | (2006.01) |
| ***F01P 7/14*** | (2006.01) |
| *F01P 3/00* | (2006.01) |

(52) U.S. Cl.

CPC ..... *F01P 3/08* (2013.01); *F01P 3/02* (2013.01); *F01P 7/14* (2013.01); *F01P 2003/006* (2013.01); *F01P 2003/024* (2013.01); *F01P 2007/146* (2013.01)

(58) Field of Classification Search

CPC ..... F01P 3/08; F01P 3/02; F01P 3/06; F01P 7/14; F01P 11/04; F01P 2003/006; F01P 2003/024; F01P 2007/146; F01M 1/06; F02F 1/00; F02F 3/20; F02F 3/22

See application file for complete search history.

(56) References Cited

U.S. PATENT DOCUMENTS

| | | | | |
|---|---|---|---|---|
| 2,966,146 | A | 10/1957 | Schweitzer et al. | |
| 4,237,847 | A | 12/1980 | Baugh et al. | |
| 4,852,534 | A | 8/1989 | Amaral | |
| 6,223,702 | B1 * | 5/2001 | Achenbach | F02F 1/10 123/41.71 |
| 6,273,050 | B1 | 8/2001 | Ko | |
| 7,360,510 | B2 | 4/2008 | Bontaz et al. | |
| 7,387,102 | B2 * | 6/2008 | Henkel | B22D 19/0072 123/196 R |
| 8,371,828 | B2 | 2/2013 | Hebrard et al. | |
| 9,765,727 | B2 | 9/2017 | Evers et al. | |
| 10,436,103 | B2 * | 10/2019 | Quix | F01P 3/02 |
| 2005/0235944 | A1 | 10/2005 | Michioka | |
| 2008/0295795 | A1 * | 12/2008 | Hollinger | F02F 7/00 123/193.2 |

(Continued)

FOREIGN PATENT DOCUMENTS

GB 2 431 217 A 4/2007

*Primary Examiner* — Grant Moubry

(74) *Attorney, Agent, or Firm* — Geoffrey Brumbaugh; Brooks Kushman P.C.

(57) ABSTRACT

An engine cylinder block includes a control valve and stratified layers defining a network internal to the cylinder block. The network includes a main feed line in fluid communication with the control valve, and branched and winding arterial channels extending from the main feed line with diameters that taper to define nozzles configured to spray coolant on sides of pistons carried within the cylinder block.

19 Claims, 5 Drawing Sheets

(56) References Cited

U.S. PATENT DOCUMENTS

| | | | | |
|---|---|---|---|---|
| 2010/0300394 | A1* | 12/2010 | Song | B22D 19/0009<br>123/195 R |
| 2014/0209046 | A1* | 7/2014 | Steiner | F01P 5/10<br>123/41.31 |
| 2015/0285126 | A1 | 10/2015 | Stellwagen | |
| 2015/0354475 | A1 | 12/2015 | Ikemoto et al. | |
| 2016/0326920 | A1* | 11/2016 | Takasaki | F01M 1/08 |
| 2016/0363040 | A1 | 12/2016 | Kim | |
| 2017/0350304 | A1 | 12/2017 | Yamashita | |

* cited by examiner

PISTON COOLING SYSTEM

CROSS-REFERENCE TO RELATED APPLICATIONS

This application is a division of U.S. application Ser. No. 15/957,127 filed Apr. 19, 2018, now U.S. Pat. No. 10,858,982, issued Dec. 8, 2020, the disclosure of which is hereby incorporated in its entirety by reference herein.

TECHNICAL FIELD

The disclosure is directed to an integral engine cylinder block and piston cooling system as well as a method of manufacturing the same.

BACKGROUND

To function properly and efficiently, an automotive engine requires cooling. Typical cooling systems include delivery of oil to different portions of the engine such as the pistons. Yet typically, piston oil delivery systems are passive systems, responding to a change of pressure within components without an ability to adjust to different performance needs of the engine.

SUMMARY

In at least one embodiment, an engine cylinder block is disclosed. The cylinder block includes a control valve. The cylinder block further includes stratified layers defining a network internal to the cylinder block. The network includes a main feed line in fluid communication with the control valve, and branched and winding arterial channels. The arterial channels may be extending from the main feed line with diameters that taper to define nozzles configured to spray coolant on sides of pistons carried within the cylinder block. The network may be disposed within an intake side of the cylinder block. The main feed line may radially traverse the cylinder block. The diameter of the main feed line may increase as a distance from the control valve increases. The control valve may be responsive to vehicle speed data. The sides are intake and exhaust sides of the pistons. The main feed line may be configured to receive the coolant from a main oil gallery. The network may further include a coolant intake port disposed within the control valve. The stratified layers may further define a main bearing saddle and wherein at least some of the channels may extend toward the main bearing saddle.

In an alternative embodiment, an engine is disclosed. The engine may include a cylinder block of layer-on-layer material defining an internal intake port, an internal main feed line in fluid communication with the intake port, and an internal network of branched arterial channels extending from the main feed line toward pistons carried within the cylinder block, the channels terminating with nozzles configured to spray coolant from the channels on the pistons. The engine may further include a plurality of control valves each dedicated to one of the channels. The control valves may be responsive to vehicle speed data. The network is disposed within an intake side of the cylinder block. The main feed line may radially traverse the cylinder block. The diameter of the main feed line may vary.

In a yet alternative embodiment, an engine system is disclosed. The engine system includes a piston. The engine system further includes a cylinder block of stratified layers defining a network of internal coolant channels that taper to define nozzles configured to spray coolant from the channels on the piston. The engine system further includes a control valve in fluid communication with the network programmed to release a predefined quantity of coolant into the network responsive to signals indicative of a state of the engine system. The network may include a coolant intake port and a main feed line and wherein the channels extend from the mail feed line. The main feed line may traverse the cylinder block. The network may be disposed on an intake side of the cylinder block. The stratified layers may be metal.

DETAILED DESCRIPTION

Figure 1:
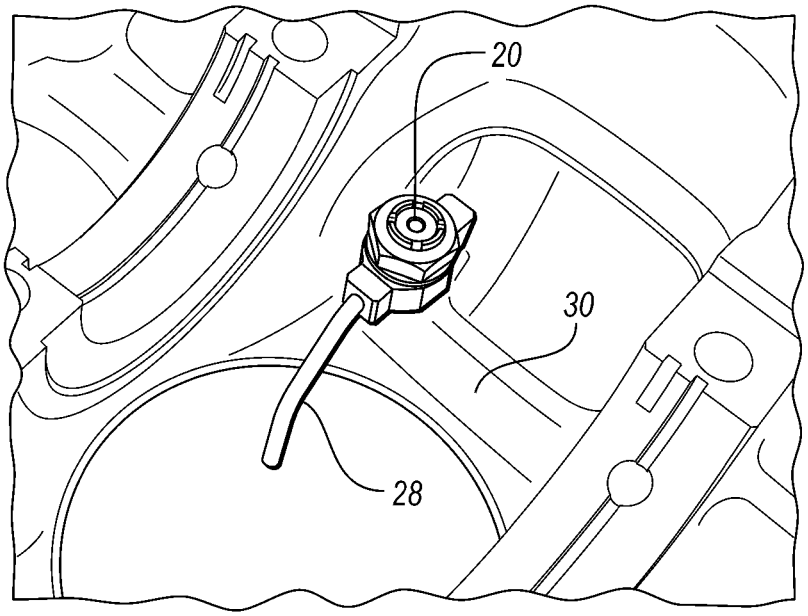
FIG. 1 (PRIOR ART)
FIGS. 1 and 2 depict portions of cylinder blocks with prior art piston cooling systems.

Reference will now be made in detail to compositions, embodiments, and methods of the present invention known to the inventors. But it should be understood that disclosed embodiments are merely exemplary of the present invention which may be embodied in various and alternative forms. Therefore, specific details disclosed herein are not to be interpreted as limiting, rather merely as representative bases for teaching one skilled in the art to variously employ the present invention.

Except where expressly indicated, all numerical quantities in this description indicating amounts of material or conditions of reaction and/or use are to be understood as modified by the word "about" in describing the broadest scope of the present invention.

The description of a group or class of materials as suitable for a given purpose in connection with one or more embodiments of the present invention implies that mixtures of any two or more of the members of the group or class are suitable. Description of constituents in chemical terms refers to the constituents at the time of addition to any combination specified in the description, and does not necessarily preclude chemical interactions among constituents of the mixture once mixed. The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

A piston is a component of a reciprocating engine, contained by a cylinder and made gas-tight by piston rings. The purpose of a piston is to transfer force from expanding gas in the cylinder to the crankshaft via a connecting rod. The piston, and especially some of its parts, are exposed to high temperatures, which can potentially cause premature wear, failure of the piston, and consequently engine damage. The highest gasoline engine piston temperatures are typically at the center of the piston crown, for diesel engine pistons with a bowl shaped piston, the maximum temperatures typically occur at the bowl rim. The temperatures may reach up to about 350° C.

Thus, the piston requires cooling. Typically, piston cooling is provided via cooling oil, which is capable of carrying away a significant portion of the heat which would otherwise pass through the piston ring region and into the cooling jacket as well as the heat passing through the skirt into the coolant jacket and the underside of the piston via oil splash to the crankcase oil.

The type of cooling is also determined by the material the piston is made from. Aluminum pistons have high conductivity and large enough surface area in contact with the liner that the piston may be operated with an oil spray directed at the bottom of the piston while not exceeding the maximum allowable piston temperature. Pistons made from iron have a smaller surface area in contact with the liner and a relatively low thermal conductivity, and oil cooling is thus required to avoid overheating of the key areas.

The maximum piston temperatures also influence power output, which may be limited by piston temperature considerations. Piston cooling may thus have a direct effect on the power output.

As a result, high specific output engines typically require other cooling features besides oil splash cooling. Most of the piston cooling systems are "passive" such that they respond automatically to a mechanical input such as specific pressure. A passive system is not customized to engine conditions. Typically, the higher the load, the higher the frequency of rotation, and the more flow of the oil from the main oil gallery to the bulkhead of the cylinder block. Two most common passive systems include a tube style system 20 and a bulkhead style system 22. An example of the tube style passive system 20 is depicted in FIG. 1.

Figure 2:
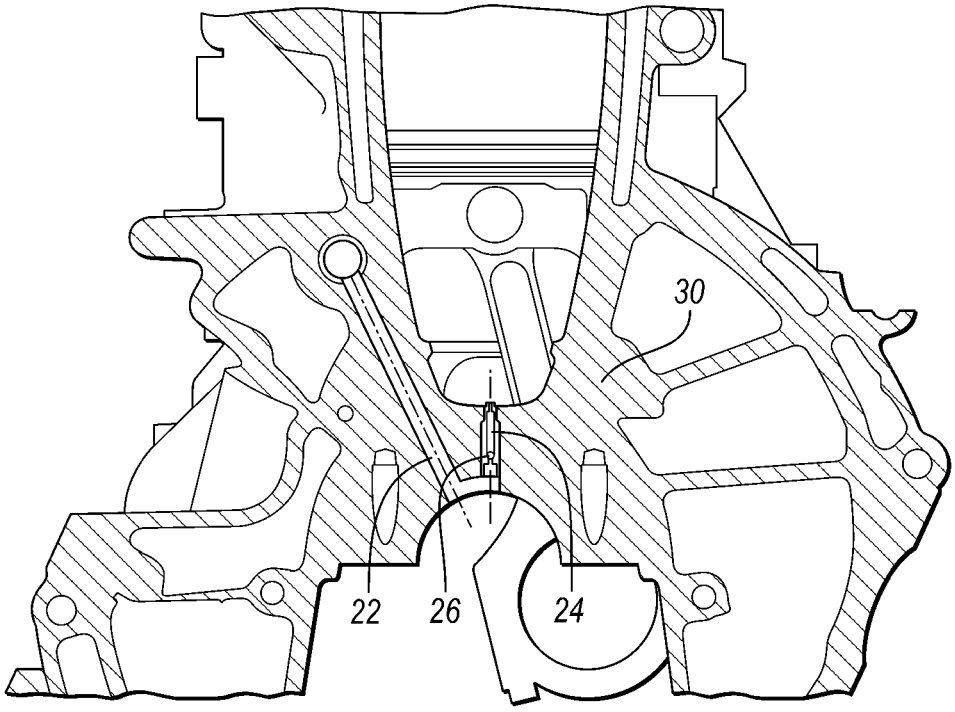
FIG. 2 (PRIOR ART)

FIG. 2 depicts an example of a bulkhead style passive cooling system 22, which works mechanically with system pressure overcoming a spring 24 and a ball 26 configuration opening an orifice, spraying engine oil directly to the lower portion of the reciprocating piston.

Both the bulkhead 22 and tube style 20 cooling systems are separate bolt-on components with respect to the engine cylinder block 30. They are not integral to the cylinder block 30, but rather are added to the cylinder block 30 as separate components. Both systems 20, 22 require fasteners to affix them in place. The bulkhead style cooling system 22 is typically easier to package and assemble. But its challenge lies in spray targeting and intermittent line of sight to the optimal target as the crankshaft counter weights obscure the "line of sight" path as the crankshaft rotates.

The tube style cooling systems 20 are typically located above the crankshaft counterweights such that the spray target is not hindered like the bulkhead style system 22. But the tube style system jets 28 are typically very small and fragile devices that may easily succumb to damage. The tube style jets 28 also require a notch in the lower portion of the cylinder bore as well as the bottom of the piston skirt.

Thus, there is a need for a more efficient piston cooling system. It would be also desirable to have a piston cooling device which would cooperate with and respond to, rather than just passively depend on, the changing needs and performance of the engine.

In one or more embodiments, an engine component 100 is disclosed. The component 100 may be an engine piston cooling device 102 depicted in FIG. 3. The device 102 includes a network 103 internal to the cylinder block. The internal network 103 may include a main feed line 104, at least one arterial channel 106, or both. The main feed line 104 may split into at least one artery or arterial channel 106. In at least one embodiment, depicted in FIG. 3, the main feed line 104 branches into a plurality of arterial channels 106, namely into 4 arteries 106, but other numbers such as 2, 3, 5, 6, 7, or 8 are contemplated. The arterial channels 106 may be branched and winding. Each artery 106 further extends into a jet 108.

The main feed line 104 may be structured as a tube-shaped line having a first end 110 and a second end 112. The main feed line 104 may have the same or different diameter along its length. For example, the diameter may increase from the first end 110 to the second end 112. The main feed line 104 may have a progressively larger diameter towards an artery 106 most distant from the first end 110.

The main feed line 104 may be straight or at least partially curved. The main feed line 104 may extend into the at least one artery 106 such that the angle between the main feed line 104 and the artery 106 is about 40 to 140°. The angle may be about 40, 45, 50, 55, 60, 65, 70, 75, 80, 85, 90, 95, 100, 105, 110, 115, 120, 125, 130, 135, or 140°.

Each artery or arterial channel 106 may include a first portion 114 bending into a curve 116 and a second portion 118 extending into a jet 108. The first portion 114, the second portion 118, or both form a feed line and may be straight or curved. The first portion 114, the second portion 118, or both may be tube-shaped lines. The curve 116 provides a transition between the first and second portions 114, 118.

The second portion 118 of the artery 106 may extend into a jet 108 directly or gradually. For example, another curve or bend 120 may be present between the second portion 118 and the jet 108. The angle between the second portion 118 and the jet 108 may be about 60 to 120°. The angle may be about 60, 65, 70, 75, 80, 85, 90, 95, 100, 105, 110, 115, or 120°. The transition between the second portion 118 and the jet 108 may be radial. In at least one embodiment, the first portion 114, the curve 116, the second portion 118, and the curve 120 may be all encompassed in one curve or a radial portion without any substantial straight portions.

Figure 3:
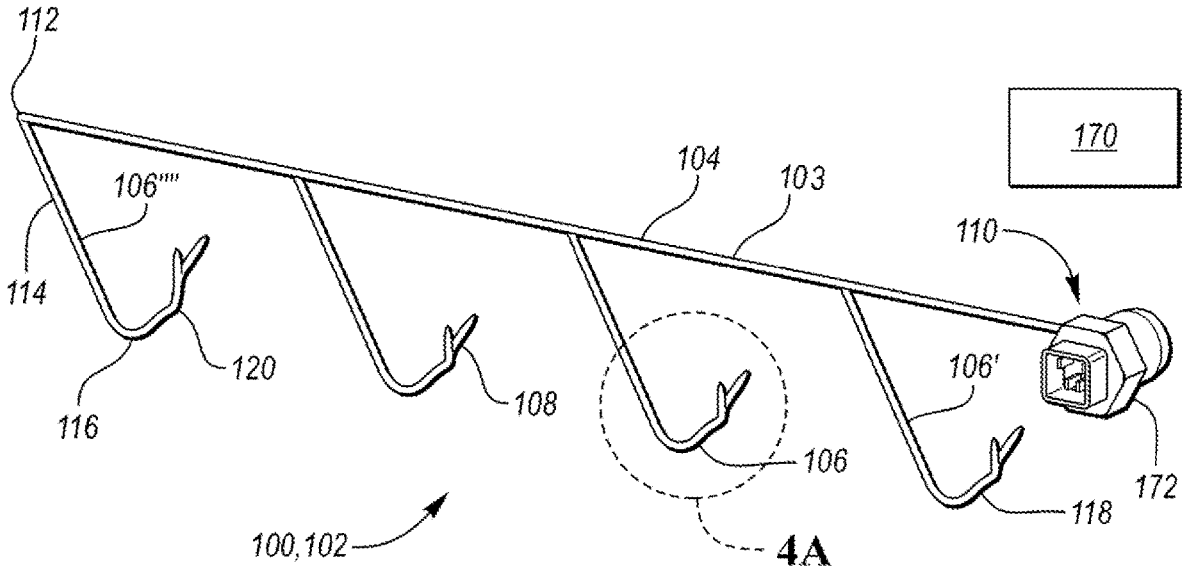
FIG. 3 depicts a perspective side view of a piston cooling device according to one or more embodiments.
Figure 4A:
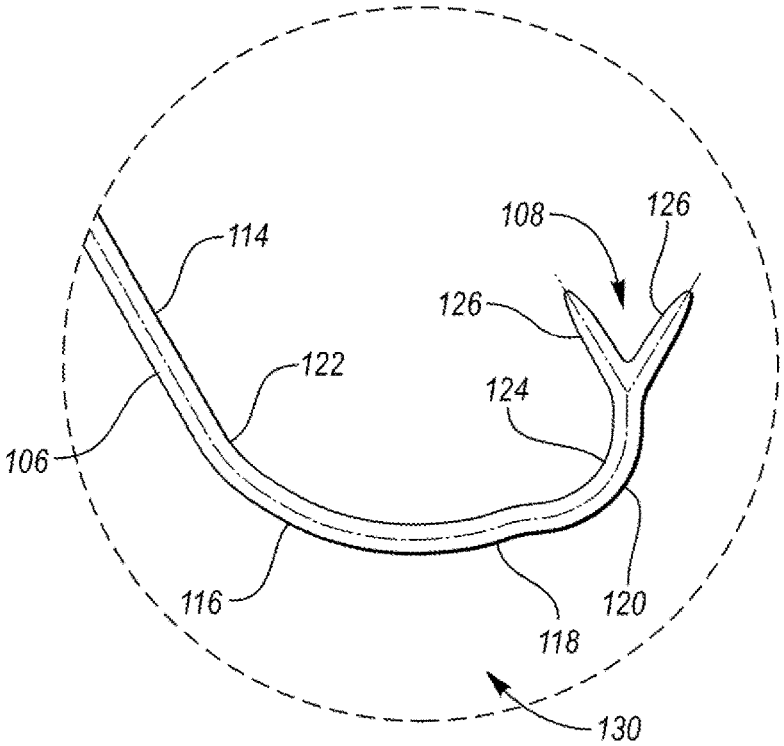
FIG. 4A shows a detailed view of a portion of the device depicted in FIG. 3.
Figure 4B:
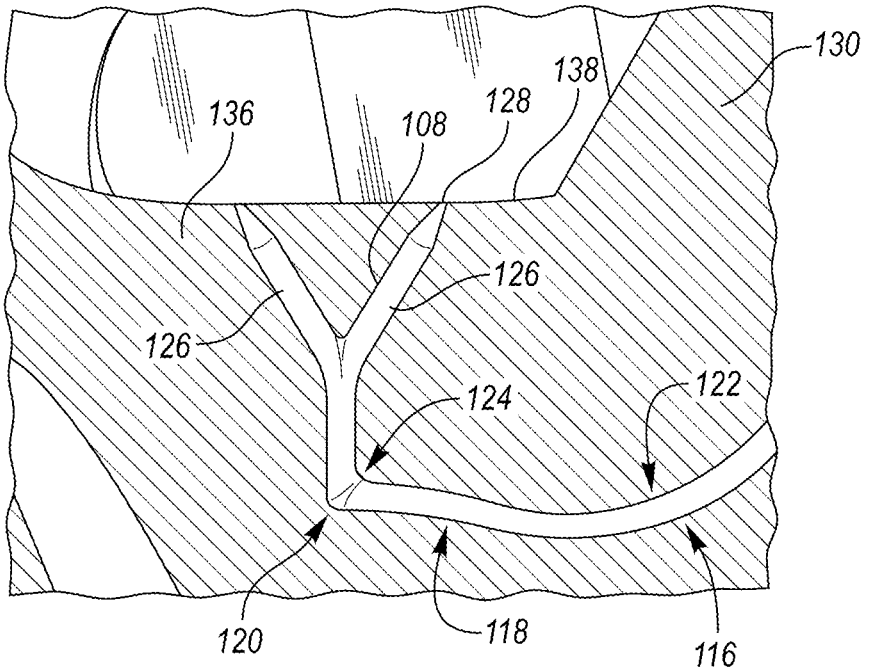
FIG. 4B depicts an alternative portion of the herein-disclosed piston assembly cooling device integrated in a cylinder block.

Example embodiments of an artery 106 of the device 102 are depicted in FIGS. 4A and 4B. FIG. 4A shows a section of the device 102 depicted in FIG. 3. In FIG. 4B, the device 102 is depicted as an integral portion of a cylinder block 130, only a section of which is shown. In FIG. 4A, the first radius of the curve 116 is larger than in FIG. 4B. Similarly, the second radius 124 of the curve 120 is larger than in FIG. 4B.

Each artery 106 may have a different or the same diameter as the remaining arteries 106. The diameter of the artery 106 may be the same or different along its length. For example, at least one portion of the artery 106 may have a different diameter than at least another portion of the artery 106. In a non-limiting example, the curve 120 may have a greater diameter in comparison with the first portion 114, second portion 118, the curve 116, or a combination thereof. The artery 106 may have a gradually increasing diameter from the main feed line 104 towards the jet 108.

The artery 106 may have a smaller, larger, or the same diameter as the feed line 104. The artery 106 may have the same diameter as a portion of the main feed line 104. For example, if the main feed line 104 has a gradually increasing diameter from the first end 110 towards the second end 112, then the artery 106' located at the first end 110 and the artery 106"" located at the second 112 may have the same diameter as the main feed line 104 where the main feed line connects to the respective artery 106', 106", but the diameter of the arteries 106' and 106"" will differ.

As can be further seen in FIGS. 4A and 4B, the artery 106 may taper, transition, extend, broaden, continue, develop, expand, or a combination thereof into a jet 108. The jet 108 may be bifurcated including two nozzles 126. The bifurcation may be symmetrical or asymmetrical, regular or irregular. The length of the nozzles 126 may be the same or different. The bifurcation may be in the shape of a letter Y or form a fork.

Figure 5:
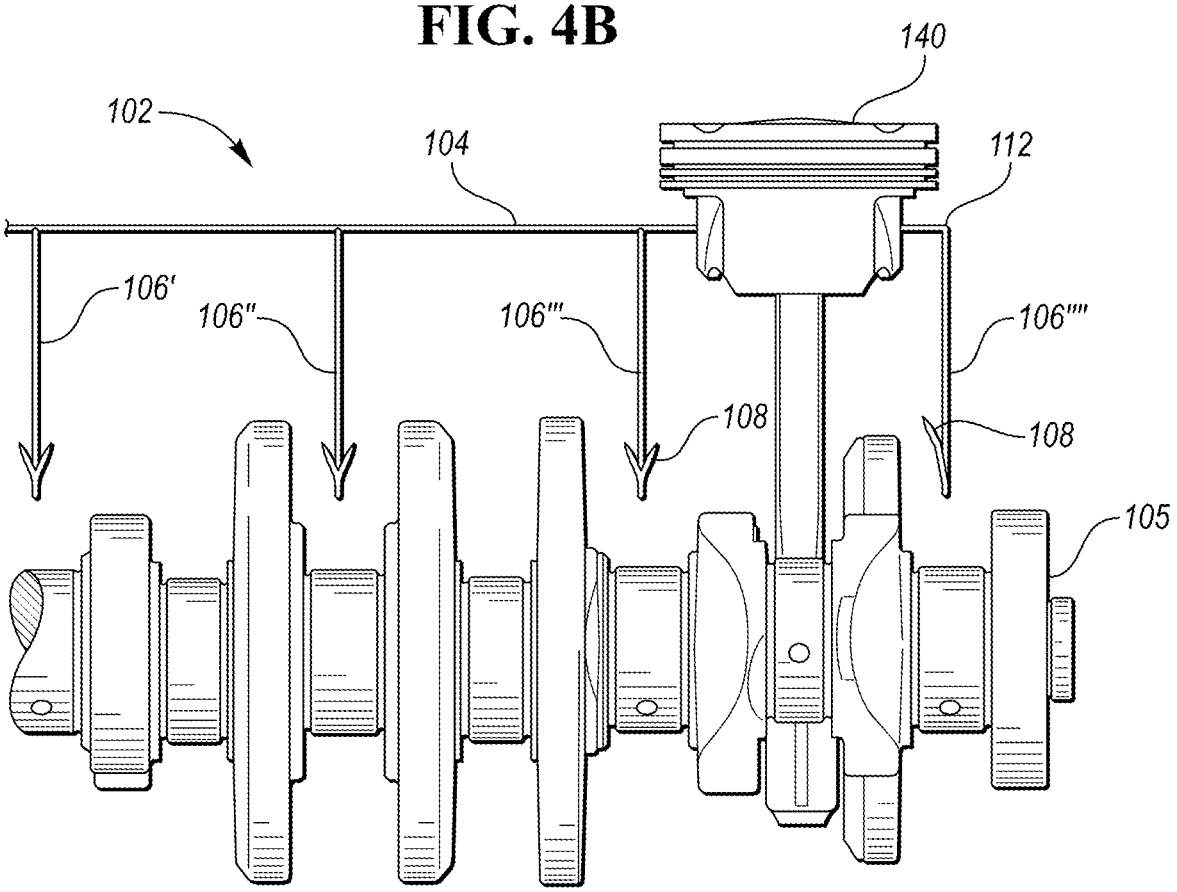
FIG. 5 illustrates a perspective view of a portion of the piston cooling device with the main feed line branching into a plurality of arteries with jets shown in relation to a crankshaft and a piston.

Alternatively, the jet 108 may include just one nozzle 126. Yet, it is desirable to include a bifurcated jet 108 such that the coolant can be supplied to two sides of the engine's piston, namely the intake side and the exhaust side. A combination of a single-nozzle and bifurcated jets 108 may be utilized in a single device 102. An example of such arrangement is depicted in FIG. 5, where the device's location is illustrated with respect to the engine's piston assembly 140 and the crankshaft 150. As can be seen in FIG. 5, two arteries 106' and 106"" are in the vicinity of the piston assembly 140 such that their jets 108 point towards the piston assembly 140. The artery 106"" branching from the second end 112 of the main feed line 104 has a single-nozzle jet 108 as there is no other piston to supply the coolant to on its other side. The remaining jets 106 include the bifurcated jets 108.

The nozzle 126 may have one or more orifices 128 capable of releasing a coolant. The nozzle 126 may be tapered such that orifice 128 has a smaller diameter than the remainder of the nozzle 126. The tip of the nozzle 126 may include one or more orifices 128 of the same or different diameter. The tip of the nozzle 126 may be flush with a surface 138 of the cylinder block 130 such as the main bearing saddle or central bulkhead 136, as is depicted in FIG. 4B. Alternatively, the tip of the nozzle 126 may extend above the surface 138 of the cylinder block in such manner as not to obstruct any portion of the engine. If the tip extends beyond the surface 138, the tip may include orifices of different diameters, angled orifices, or both to disperse the coolant towards the piston assembly 140.

Figure 6:
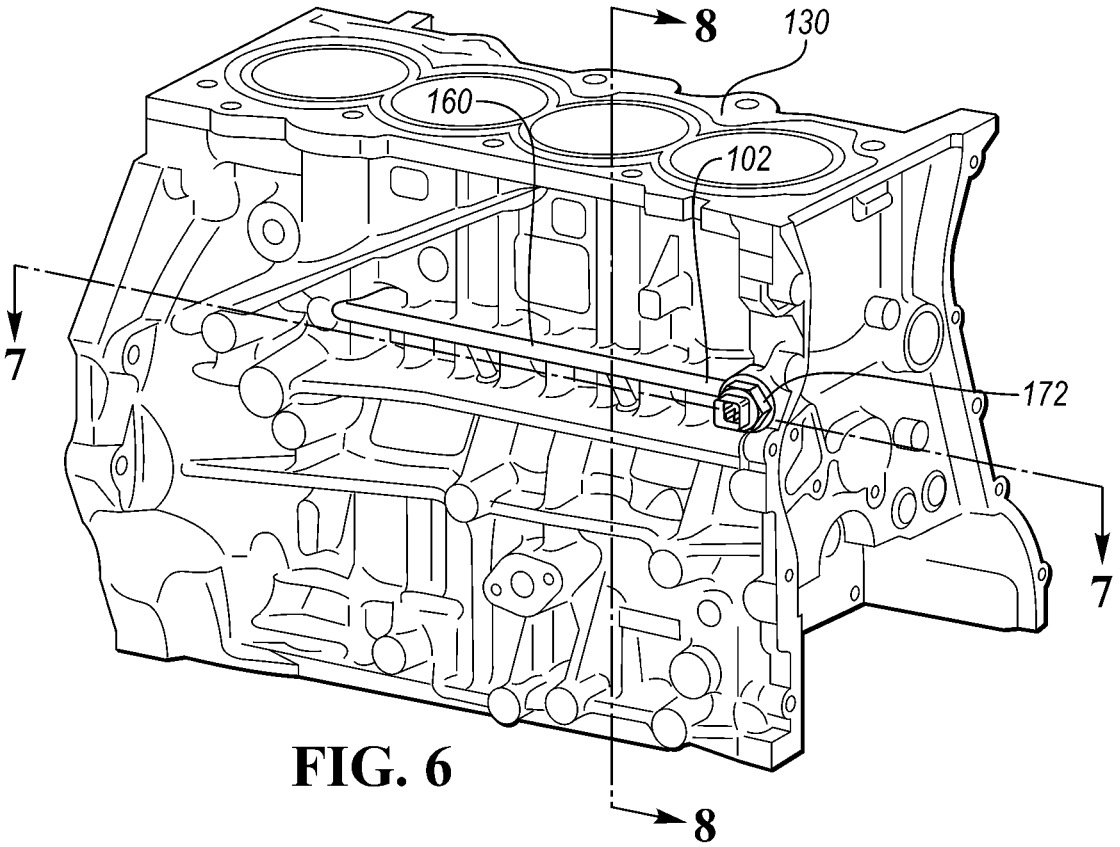
FIG. 6 shows a perspective view of a cylinder block with a platform supporting the piston cooling device disclosed herein.
Figure 7:
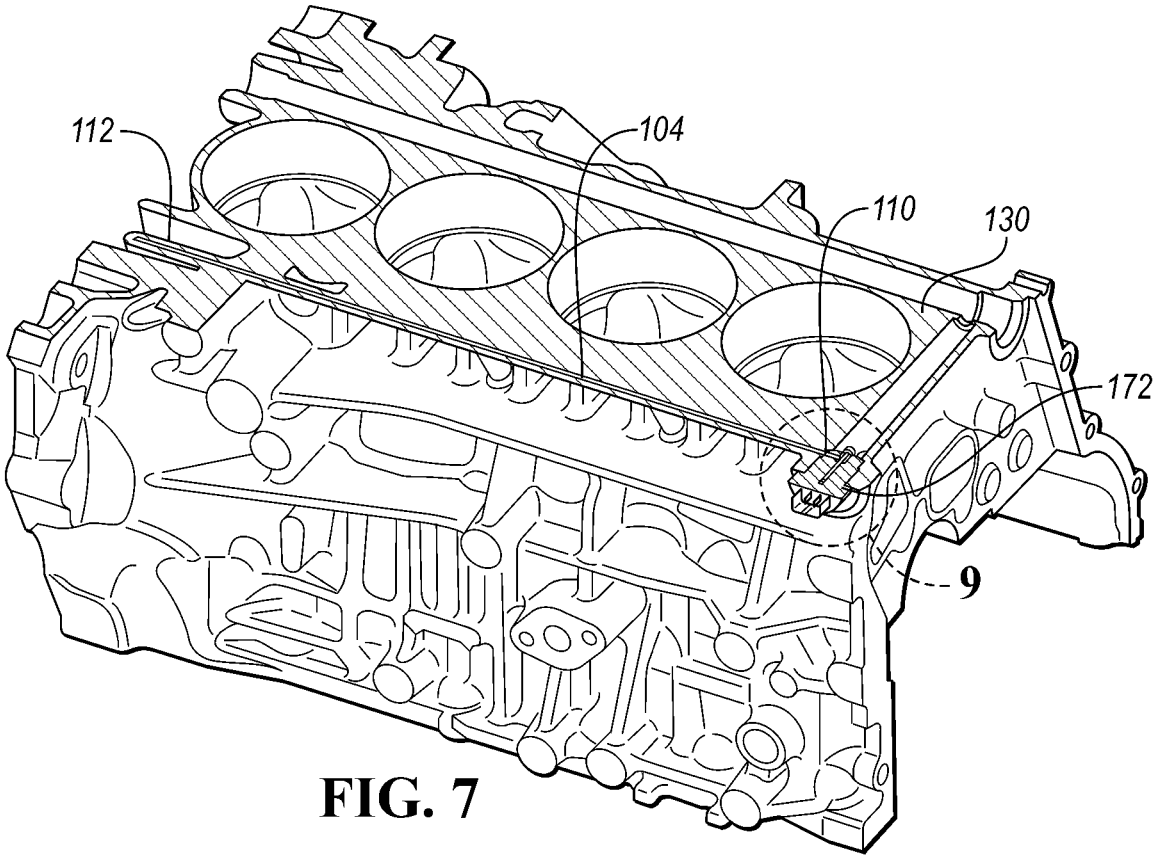
FIG. 7 shows a perspective cross-section view of the cylinder block along the line 7-7, depicting the main feed line and a control valve of the piston cooling device disclosed herein.
Figure 8:
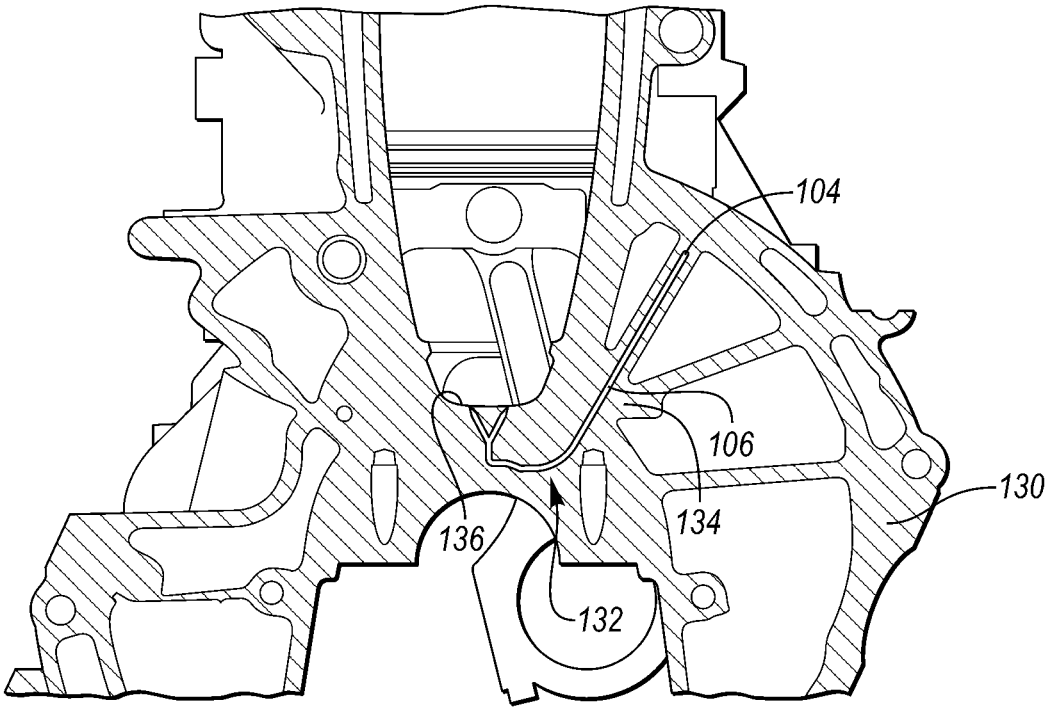
FIG. 8 shows an alternative cross-sectional view of the cylinder block depicted in FIG. 6 along the line 8-8, showing an artery with a bifurcated jet of the piston cooling device.

The device 102 forms an integral part of a cylinder block 130, as is illustrated in FIGS. 6-8. FIG. 6 depicts a cylinder block 130 with the device 102 forming an integral part of the cylinder block 130. The device 102 may be placed within a platform 160. The platform 160 may provide a support for the device 102, stiffening of the cylinder block 130, or both.

The device 102, as depicted, is located on the intake side of the cylinder block 130. The placement on the intake side is desirable for spatial and other reasons. In this arrangement, delivery of the coolant to both sides, intake and exhaust side, of the piston is feasible and enabled by the herein-described arrangements. This is in contrast with the typical piston cooling systems which focus on oil delivery to the exhaust side only. Yet, location of the device 102 on the exhaust side, or both sides, of the cylinder block 130 is possible as well.

FIG. 7 shows a cross-sectional view of the cylinder block 130, providing a view of the main feed line 104. As can be seen in FIG. 7, the main feed line 104 extends across the length of the cylinder block 130. The main feed line 104 radially transverses the cylinder block 130. Due to the arrangement, the arteries 106 extending from the main feed line 104 may provide coolant across the length of the cylinder block 130.

FIG. 8 shows a different cross-sectional view of the cylinder block 130, depicting an artery 106 extending from the main feed line 104 throughout the cylinder block 130. The artery 106 extends from the main feed line 104 through the main bearing web 132 and bulkhead 134 to the main bearing saddle or central bulkhead 136.

Figure 9:
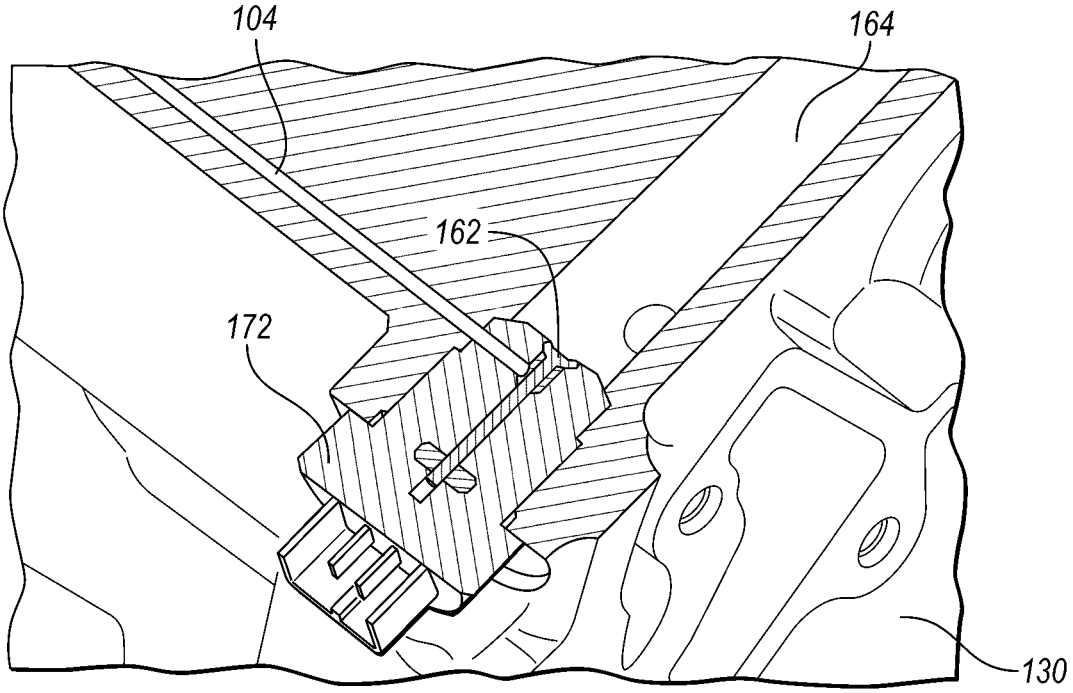
FIG. 9 illustrates a detailed view of a portion of the piston cooling device shown in FIG. 7.

The device 102 is designed to lead and distribute a coolant to the engine piston assemblies 140. The coolant may be oil such as a typical engine cooling oil. The coolant may be oil collected from the main oil gallery and lead to the device 102 via a channel 164 and a coolant intake port or orifice 162. Example of the coolant intake port 162 is depicted in FIG. 9, which shows a detailed portion of FIG. 7. The coolant intake port 162 may be connected to the main feed line 104, a control valve 172, or both. The intake port 162 may be an orifice. The intake port 162 may have any shape, size, or configuration as long as the intake port 162 is capable of providing a coolant to the main feed line 104, the control valve 172, or both.

The device 102 may be in communication with a controller 170, which is schematically depicted in FIG. 3. The communication may be facilitated via a control valve 172. The control valve 172 is a valve capable of controlling or regulating the amount of the coolant, or the coolant flow, by varying the size of the flow passage as directed by a signal from a controller 170. The control valve 172 thus enables a direct control of the coolant flow rate and the process quantities such as pressure, temperature, and coolant level.

A non-limiting example of a control valve 172 is depicted in FIGS. 3, 7, and 9. The control valve 172 may be connected to the main feed line 104, the at least one arterial channel 106, the coolant intake port 162, or both. The control valve 172 may be in fluid communication with the network 103. The control valve 172 may be in communication with an engine control module or another controller 170. The control valve 172 may send signals, receive signals, or both to/from the engine control module or another controller 170. The control valve 172 may be capable of responding to a signal from the engine control module or another controller 170. The signal may be a series of data points representing a speed of a vehicle versus time. The signal may be information about the engine's drive cycle, changes in the drive cycle, anticipated changes in the drive cycle, the like, or a combination thereof. The control valve 172 may be programmed to release a predefined quantity of coolant into the network 103 responsive to signals indicative of a state of the engine system.

In response to the signal, the control valve 172 may open fully, partially, or close, metering the amount of coolant to be released into the main feed line 104, the at least one artery 106, to the bulkhead 136, and ultimately to the piston assemblies 140. The device 102 with the control valve 172 thus represents an active system which controls flow of the coolant to the bulkhead 136 and the piston assemblies 140 electronically and in response to changing needs of the engine. For example, during idling when the amount of heat created in the engine is relatively low, the amount of the coolant required is relatively low as well. The signal from the controller 170 would thus reflect a relatively low need for the release of the coolant into the device 102, and the control valve 172 would release a relatively low amount of the coolant in response to the signal. When the heat generated exceeds certain threshold, the controller 170 sends a signal to the control valve 172 to increase the coolant flow to provide sufficient cooling to the piston assemblies 140.

The control valve 172 may include an actuator. The control valve 172 may open or close under a spring pressure, by backup power, or otherwise. The control valve 172 may be a valve with a sliding stem such as a globe valve, angle body valve, or a rotary valve such as a butterfly valve or ball valve. Other types of valves are contemplated.

While the depicted device 102 shows just one control valve 172, the device 102 may include more than one control valve 172. For example, each artery 106 may have a dedicated control valve 172. The control valve 172 may be located at the point of intersection of the main feed line 104 and the artery 106. All control valves 172 may be in communication with the same controller 170 such as the engine control module.

A method of forming the cylinder block 130 with the integral device 102 is also disclosed herein. The enabler for production of the disclosed integral cylinder block 130 and device 102, having unique structural features depicted in the Figures and described above, may be additive manufacturing. Additive manufacturing processes relate to technologies that build 3-D objects by adding layer upon layer of material. The result is a stratified object which may feature unique, detailed structures, not producible by other technologies. The material may be plastic, metal, composite, the like, or a combination thereof. Additive manufacturing includes a number of technologies such as 3-D printing, rapid prototyping, direct manufacturing, layered manufacturing, additive fabrication, vat photopolymerization including stereolithography (SLA) and digital light processing (DLP), material jetting, binder jetting, material extrusion, powder bed fusion, sheet lamination, directed energy deposition, and the like.

Early additive manufacturing focused on pre-production visualization models, fabricating prototypes, and the like. The quality of the fabricated articles determines their use and vice versa. The early articles formed by additive manufacturing were generally not designed to withstand long-term use. The additive manufacturing equipment was also expensive, and the speed was a hindrance to a widespread use of additive manufacturing for high volume applications. But recently, additive manufacturing processes have become faster and less expensive. Additive manufacturing technologies have also improved regarding the quality of the fabricated articles.

Any additive manufacturing technique may be used to produce the disclosed integral cylinder block 130 with the device 102 as additive manufacturing technologies operate according to a similar principle. The method may include utilizing a computer, 3-D modeling software (Computer Aided Design or CAD), a machine capable of applying material to create the layered integral cylinder block, and the layering material. An example method may also include creating a virtual design of the integral cylinder block in a CAD file using a 3-D modeling program or with the use of a 3-D scanner which makes a 3-D digital copy of the integral cylinder block, for example from an already created integral cylinder block. The method may include slicing the digital file, with each slice containing data so that the cylinder block 130 and the device 102 may be formed layer by layer or layer-on-layer. The method may include reading of every slice by a machine applying the layering material. The method may include adding successive layers of the layering material in liquid, powder, or sheet format, and forming the integral cylinder block 130 and the device 102 while joining each layer with the next layer so that there are hardly any visually discernable signs of the discreetly applied layers. The layers form the three-dimensional solid cylinder block 130, the platform 160, the coolant intake port 162, the channel 164 for the coolant delivery, the network 103, the main feed line 104, the arteries 106, the jets 108. The control valve 172 or at least some of its portions may be also manufactured by additive manufacturing as integral portions of the cylinder block 130 and the device 102.

In an alternative embodiment, the control valve 172 or at least one of its portions are manufactured by a different method than additive manufacturing. The control valve 172, or at least one of its portions, may be thus manufactured separately from the cylinder block 130 and the device 102. The control valve 172 or at least one of its portions may be then plugged in, inserted, or connected to the cylinder block 130, the device 102, or both after the additive manufacturing process is completed.

The additively manufactured cylinder block 130 and the device 102 may need to undergo one or more post-processing steps to yield the final 3-D object, for example stabilizing. Stabilizing relates to adjusting, modifying, enhancing, altering, securing, maintaining, preserving, balancing, or changing of one or more properties of the integral cylinder block formed by additive manufacturing such that the formed integral cylinder block meets predetermined standards post-manufacturing.

The stabilized cylinder block 130 with the device 102 remains in compliance with various standards for several hours, days, weeks, months, years, and/or decades after manufacturing. The property to be altered may relate to physical, chemical, optical, and/or mechanical properties. The properties may include dimensional stability, functionality, durability, wear-resistance, fade-resistance, chemical-resistance, water-resistance, ultra-violet (UV)-resistance, thermal resistance, memory retention, desired gloss, color, mechanical properties such as toughness, strength, flexibility, extension, the like, or a combination thereof.

Additive manufacturing enables formation of intricate shapes, undulating shapes, networks, winding shapes, smooth contours, and gradual transitions between adjacent segments or parts of the cylinder block 130 and the device 102 resulting in a more even distribution of the coolant to the bulkhead 136 and the piston assemblies 140. For example, the network 103, the jets 108, the bifurcation of the jets 108, the fine nozzles 126, and small orifices 128 are not feasibly manufacturable by drilling, milling, or traditional machining. The cylinder block 130 and the device 102 formed by the method described above may be free of any is, adhesive, or other types of bonds typical for traditional cylinder block manufacturing.

The processes, methods, or algorithms disclosed herein may be deliverable to or implemented by a processing device, controller, or computer, which may include any existing programmable electronic control unit or dedicated electronic control unit. Similarly, the processes, methods, or algorithms may be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms may also be implemented in a software executable object. Alternatively, the processes, methods, or algorithms may be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. An engine system comprising:

a piston;

a cylinder block of stratified layers defining a network of internal coolant channels that taper to define nozzles configured to spray coolant from the channels on the piston; and a control valve, in fluid communication with the network, programmed to release a predefined quantity of a coolant into the network responsive to signals indicative of a state of the engine system.

2. The engine system of claim 1, further comprising a controller in communication with the control valve.

3. The engine system of claim 2, wherein the controller is an engine control module of a vehicle.

4. The engine system of claim 2, wherein the control valve regulates a flow of the coolant by varying a size of a flow passage as directed by a signal from the controller.

5. The engine of claim 2, wherein the signals are provided by the controller.

6. The engine system of claim 1, wherein the network includes a coolant intake port and a main feed line and wherein the channels extend from the main feed line.

7. The engine system of claim 6, wherein the main feed line traverses the cylinder block.

8. The engine system of claim 6, further comprising a main oil gallery, wherein the main feed line is configured to receive the coolant from the main oil gallery.

9. The engine system of claim 1, wherein the control valve is connected to the main feed line.

10. The engine of claim 1, wherein the signals are a series of data points representing a speed of a vehicle versus time.

11. The engine system of claim 1, wherein the network is disposed on an intake side of the cylinder block.

12. The engine system of claim 1, wherein the stratified layers are metal.

13. The engine system of claim 1, wherein the network forms an integral part of the cylinder block being free of fasteners and adhesives.

14. The engine system of claim 1, wherein each coolant channel tapers into a jet, at least one of the jets being bifurcated into two nozzles.

15. The engine system of claim 1, wherein the signal is an information about a drive cycle of the engine system.

16. The engine system of claim 1, further comprising at least one additional control valve.

17. The engine system of claim 16, further comprising a controller in communication with the control valve, wherein the at least one additional valve is in communication with the controller.

18. The engine system of claim 16, wherein the network further includes a coolant intake port disposed within the control valve.

19. The engine system of claim 1, wherein each internal coolant channel includes a dedicated control valve.

* * * * *